US005606812A

United States Patent [19]

Jensen

[11] Patent Number: 5,606,812

[45] Date of Patent: Mar. 4, 1997

[54] DEVICE FOR INSERTING LAUNDRY ARTICLES INTO A FEEDER

[75] Inventor: Jørn M. Jensen, Bern, Switzerland

[73] Assignee: Ejnar Jensen & Søn A/S, Rønne, Denmark

[21] Appl. No.: 432,429

[22] Filed: Apr. 27, 1995

[30] Foreign Application Priority Data

Apr. 28, 1994 [DK] Denmark ..... 0490/94

[51] Int. Cl.[6] ..... D06F 67/04

[52] U.S. Cl. ..... 38/143; 26/87

[58] Field of Search ..... 38/143; 162/270, 162/271; 271/234, 235, 245; 26/87, 98

[56] References Cited

U.S. PATENT DOCUMENTS

| | | | |
|---|---|---|---|
| 1,503,858 | 8/1924 | Steiner | 38/143 X |
| 3,228,127 | 1/1966 | Roiland | 38/143 |
| 3,399,472 | 9/1968 | Evans | 38/143 |
| 3,414,997 | 12/1968 | Henry | 38/143 |
| 3,735,512 | 5/1973 | Ross | 38/143 |
| 3,772,808 | 11/1973 | Behn | 38/143 |
| 5,349,768 | 9/1994 | Ishihara et al. | 38/143 |
| 5,416,992 | 5/1995 | Ueda et al. | 38/143 |

FOREIGN PATENT DOCUMENTS

| | | |
|---|---|---|
| 0419382A1 | 3/1991 | European Pat. Off. . |
| 0424290A1 | 4/1991 | European Pat. Off. . |
| 0609945A1 | 8/1994 | European Pat. Off. . |

*Primary Examiner*—Ismael Izaguirre
*Attorney, Agent, or Firm*—Finnegan, Henderson, Farabow, Garrett & Dunner

[57] ABSTRACT

A device for inserting laundry articles into a feeder, comprising a conveyor which is adapted to first grip a stretched portion of a front edge on the laundry article and then to convey the laundry article into the feeder with the front edge foremost in the direction of feed, an underlying horn being positioned in front of the conveyor with respect to the direction of feed such that the laundry article is pulled across the horn, an overlying horn being provided between the conveyor and the underlying horn such that the laundry article during the insertion is pulled below the overlying horn in engagement with it. This ensures effective smoothing-out of any creases on the laundry article before it is inserted into the feeder.

9 Claims, 3 Drawing Sheets

DEVICE FOR INSERTING LAUNDRY ARTICLES INTO A FEEDER

BACKGROUND OF THE INVENTION

The present invention concerns a device for inserting laundry articles into a feeder.

Feeders are primarily used in big laundries in which they are used for smoothing and spreading large laundry articles, such as sheets, table-cloths, slips for eiderdowns, etc. for subsequent insertion of the laundry article into e.g. an ironing roller, it being important that these feeding devices spread and smooth the laundry articles effectively so that undesired creases will not occur after the ironing roller. These feeders frequently comprise a device for inserting laundry articles into the feeder of the type mentioned above. Most frequently, the laundry articles are inserted into the apparatus in that a laundry article is taken from a pile of laundry articles in a wrinkled state and optionally wet or damp. Then the laundry article is inserted into the machine.

Examples of prior art of this type are disclosed in e.g. EP Patent Application 424 290 and EP Patent Application 419 382. To ensure that the laundry article which is inserted into the feeder, is free of creases and the like to the greatest possible extent, these known devices are provided with a horn across which the laundry article is pulled when being inserted. These horns hereby provide a spreading movement of the laundry article so that many of the creases in the laundry article are smoothed out or removed.

The underlying horn thus has two effects: primarily a smoothing-out effect in that the laundry article hangs down on both sides of the horn, and secondly the horn can grip the creases with its front edge to stretch these during the movement of the laundry article across the horn.

However, it has been found in practice that not all creases are smoothed out satisfactorily using such a horn, since the front edge of the horn can just grip creases which extend below the laundry article and forward with respect to the direction of feed of the laundry article. Creases which conversely extend upward from the laundry article and forward with respect to the direction of feed of the laundry article, are not always smoothed out satisfactorily. This is inexpedient, because this requires subsequent smoothing-out in the feeder machine, which may be expensive and difficult to establish, and which additionally frequently results in a prolonged process time for each laundry article causing reduced efficiency.

The object of the present invention is therefore to provide a device for inserting laundry articles into a feeder, which improves the certainty that laundry articles are not inserted into the feeder with creases extending upward and forward in the direction of feed such that the process time for insertion of laundry articles is usually not prolonged.

SUMMARY OF THE INVENTION

This object is achieved by providing a device for inserting laundry articles into a feeder, comprising a conveyor which is adapted first to grip a stretched portion of a front edge on the laundry article and then to convey the laundry article into the feeder with the front edge foremost in the direction of feed, an underlying horn being positioned in front of the conveyor with respect to the direction of feed, such that the laundry article is pulled across the horn below the insertion conveyor, characterized in that an overlying horn is provided between the conveyor and the underlying horn such that the laundry article during the insertion is pulled below the overlying horn and in engagement with it.

BRIEF DESCRIPTION OF THE DRAWINGS

The invention will be described in an expedient embodiment with reference to the drawing, in which.

DETAILED DESCRIPTION OF THE INVENTION

Figure 1:
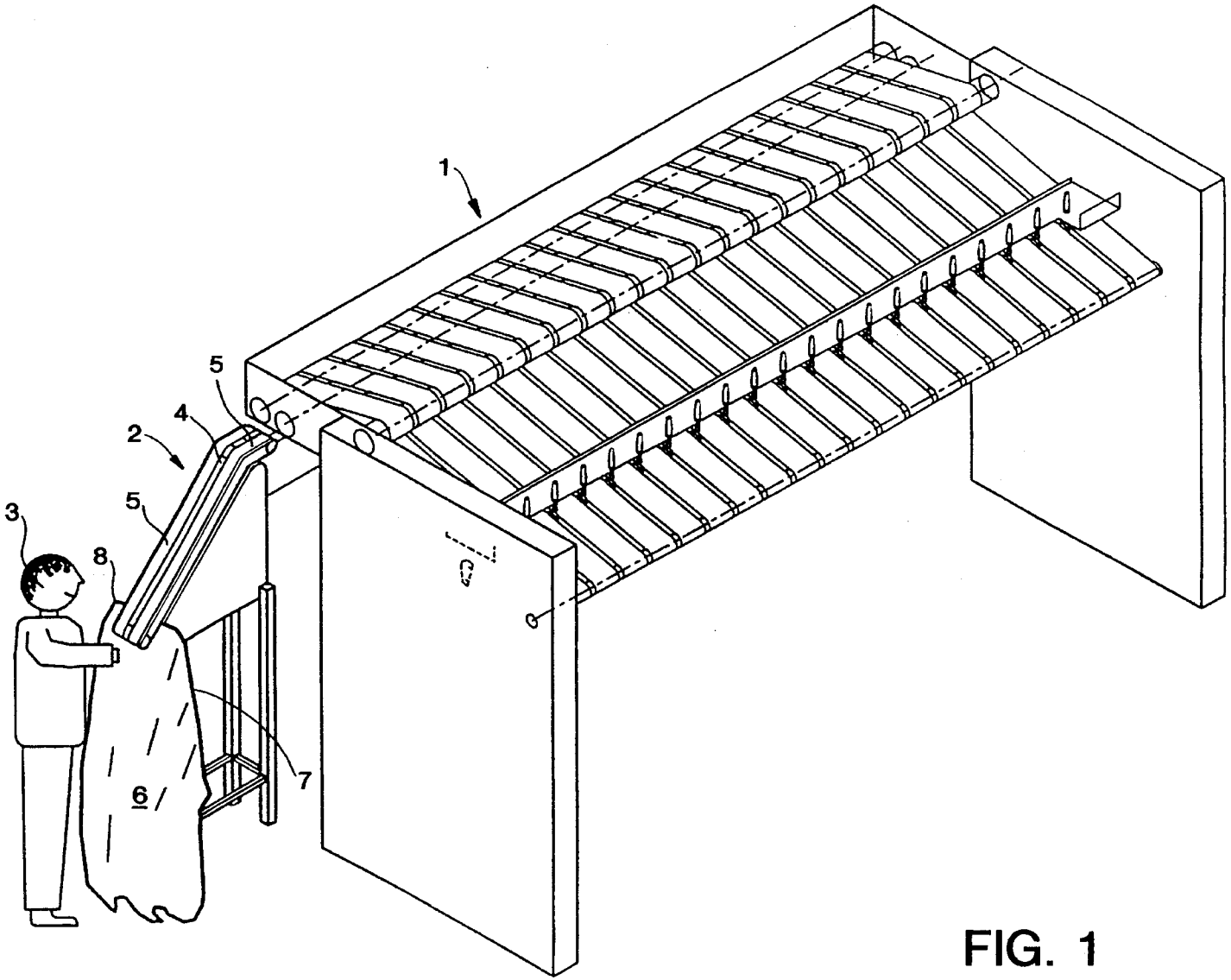
FIG. 1 is a pictorial view of a feeder.

FIG. 1 shows a feeder 1 with which an insertion device 2 is provided. The insertion device 2 is operated manually by an operator 3, and it comprises a conveyor 4 which here comprises two juxtaposed conveyor belts 5. To operate the feeder 1, the operator inserts the laundry article 6 into the conveyor 4, which is activated to pull the laundry article 6 into the feeder 1. For reasons of productivity, this feeder 1 allows the laundry article 6 to be inserted into the conveyor 4 by stretching of a small portion of a front edge 7 at one corner 8 of the laundry article. The operator 3 can hereby insert the laundry article 6 into the feeder 1 simply and quickly merely by finding a corner 8 on the laundry article 6.

The feeder 1 is shown in FIG. 1 without a horn arrangement according to the invention, since FIG. 1 just serves to illustrate the field of use of the invention. However, it will be seen from this figure that if the laundry article 6 creases or wrinkles, this involves the risk that the laundry article 6 is inserted into the feeder with these creases and wrinkles maintained, which is inexpedient of course.

The actual feeder 1 will not be described in further detail in this context, since the present invention may be applied to feeders of different structures.

Figure 2:
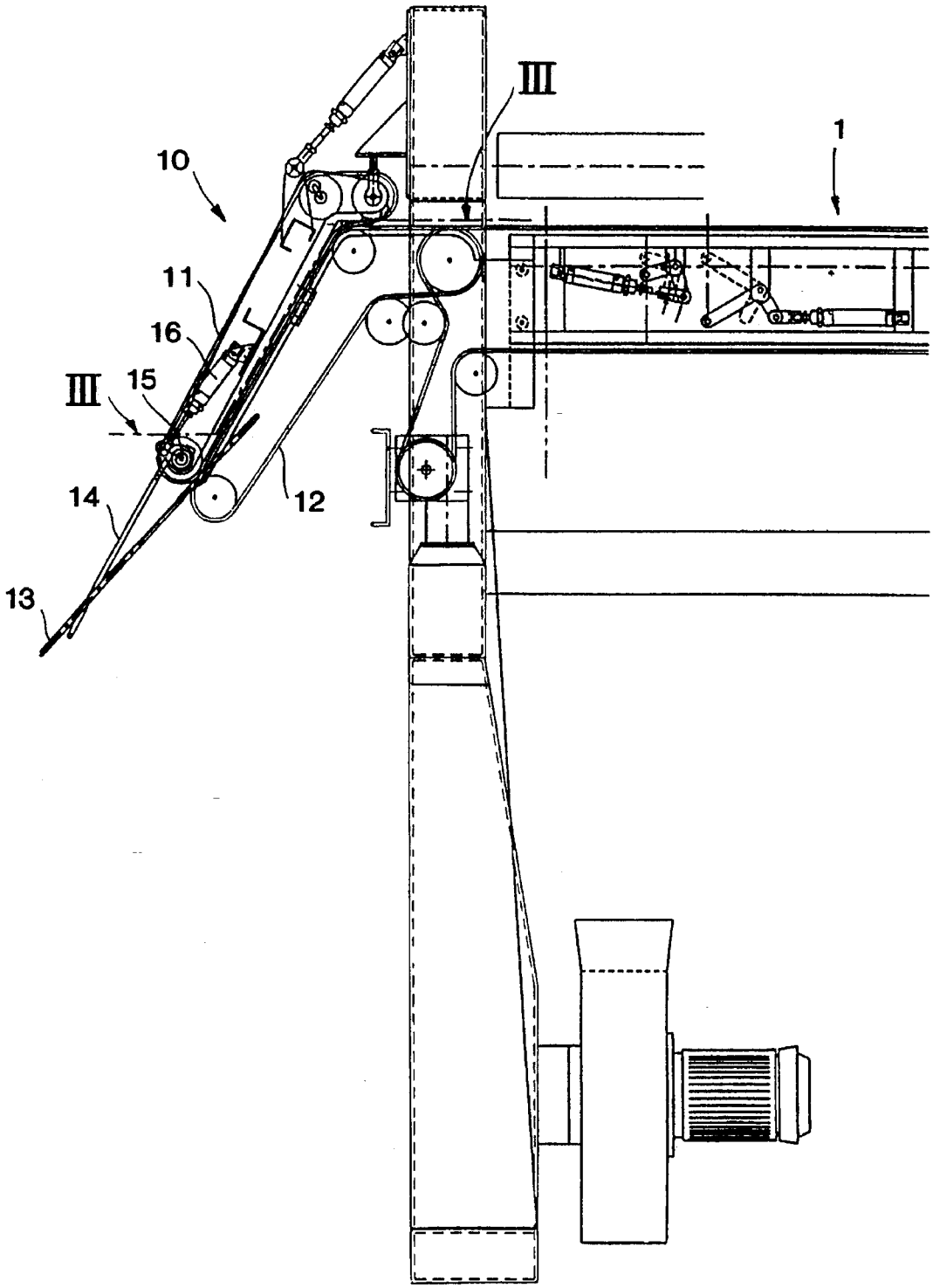
FIG. 2 is a lateral sectional view of a feeder having an insertion device according to the invention.
Figure 3:
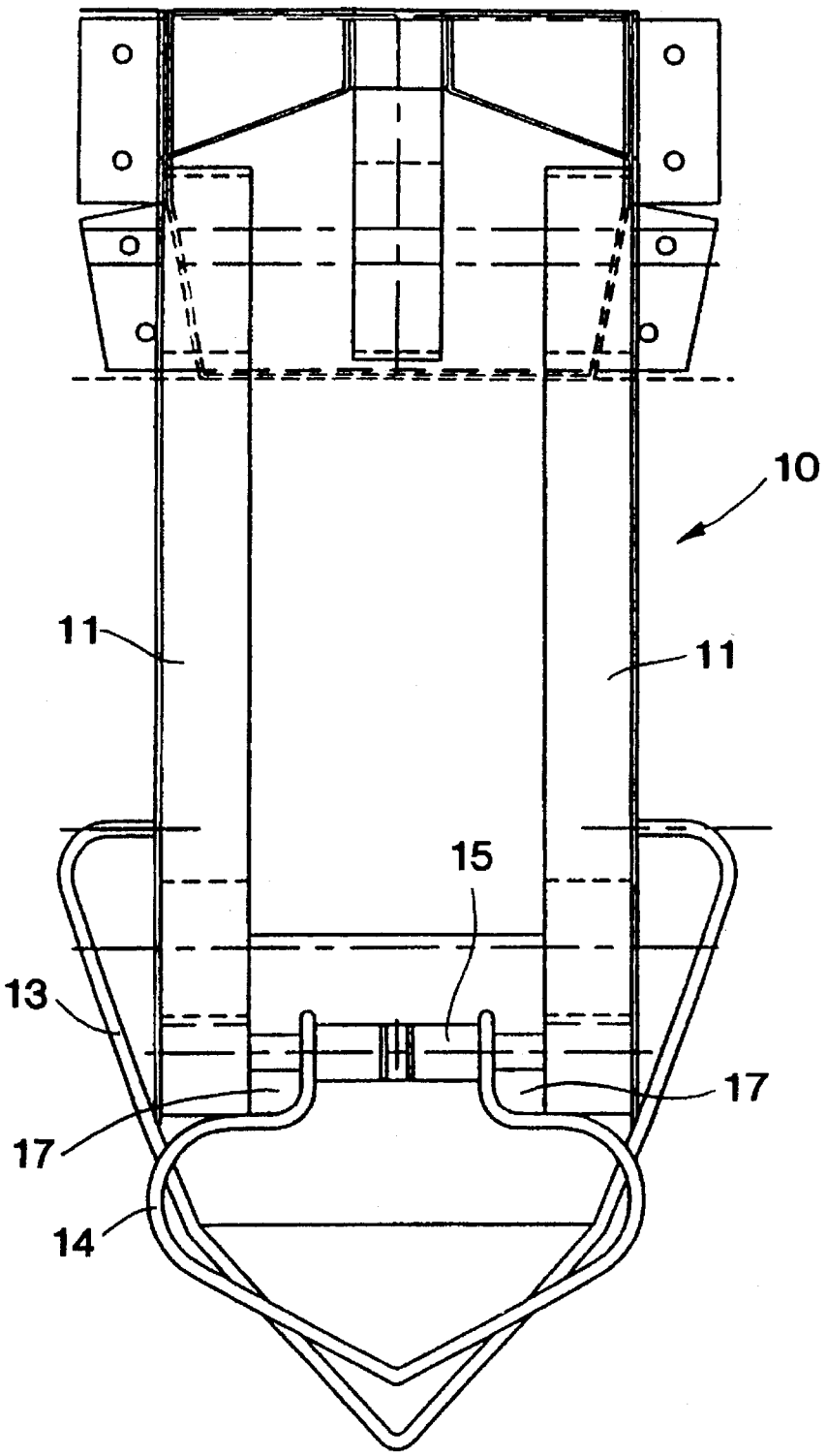
FIG. 3 is a sectional view of the insertion device taken along the line III—III in FIG. 2

However, FIG. 2 and FIG. 3 show part of the feeder 1 of FIG. 1 with an insertion device 10 according to the invention. FIG. 3 is a sectional view along the line III—III in FIG. 2.

The insertion device comprises a conveyor consisting of two juxtaposed, overlying conveyor belts 11. These conveyor belts engage two underlying belts 12. The laundry article (not shown) may then be inserted between the overlying and the underlying conveyor belts 11 and 12, as appears from FIG. 1, following which the conveyor belts 11 and 12 are activated to pull the laundry article (not shown) into the feeder 1.

An underlying horn 13, which is secured with respect to underlying conveyor belts 12, is arranged in a known manner at the outer end of the conveyor belt. When a laundry article is inserted into the insertion device, the laundry article is pulled across the underlying horn 13 and rests on this in a known manner. The underlying horn hereby causes spreading of the laundry article so that any creases and the like are smoothed out or removed. However, it is likely that not all creases are smoothed out using just this underlying horn 13 according to the prior art, since particularly creases extending across the laundry article and forward with respect to the direction of feed of the laundry article are not always smoothed out.

Accordingly, the insertion device 10 is provided with a further, overlying horn 14 according to the invention. Thus, according to the invention, the overlying horn 14 is located such that a laundry article may be pulled between the underlying horn 13 and the overlying horn 14 and then be moved into the conveyor belts 11 and 12 of the insertion device 10, following which the laundry article engages both the underlying horn 13 and the overlying horn 14, so that the overlying horn grips particularly creases which extend across the laundry article and forward in the direction of feed.

This effect obtained by using an overlying horn according to the invention is particularly pronounced if the front edge of the overlying horn 14 intersects the front edge of the underlying horn 13, as is shown in FIGS. 2 and 3, so that the laundry article follows a labyrinth path. The creases extending upward from the laundry article and forward in the direction of feed are thereby lifted slightly with respect to the laundry article, after passing the underlying horn so that the overlying horn 14 with greater certainty grips below the crease.

To facilitate the insertion of the laundry article into the insertion device 10, the overlying horn 14 is pivotally mounted with respect to the overlying conveyor belts 11 by means of the bearings 15 in the embodiment shown in FIGS. 2 and 3. The overlying horn 14 may hereby be pivoted upward and away from the underlying horn 13 by means actuator such as a pneumatic cylinder 16. After insertion of a laundry article into the insertion device 10, the overlying horn 14 is pivoted back to the position shown.

By moving the overlying horn upward and clearing the underlying horn, an extremely easy and unproblematic manual insertion of the laundry article into the insertion device is achieved. The actuator may either be adapted for manual operation, or be automatically controlled by suitable control means.

The front edges of the horns may preferably be made of a shaped wire or rod material, thereby providing an extremely inexpensive structure.

The insertion device may be constructed as an independent unit which is connected with a feeder. Preferably, however, as shown the insertion device forms part of the feeder.

It is clear that the present invention may be varied in many ways with respect to the embodiment shown without departing from the basic principle of the invention; thus, the horn may be shaped in many ways and in different materials, such as sheets and the like. In addition, it is possible for the underlying horn to be pulled away from the overlying one instead of the reverse, and the position of the horns with respect to each other may be selected freely, provided that the laundry article is swept by both horns during the transport of the laundry article.

It is moreover simple to a skilled person to establish the said control functions to control the functions of the insertion device 10 both with a view to manual and to automatic control of these. Thus, sensors 17, as shown in FIG. 3, may be provided at the conveyor belts 11 and 12 so that the presence of a laundry article at the outer end of the conveyor belt may be detected, following which an automatic process may be initiated with suitable control means with a view to e.g. positioning of the overlying horn 14, activation of the conveyor belts 11 and 12 and optional coordination with the functions of the feeder, so as to ensure that laundry articles are not inserted into the feeder when the feeder is not ready to receive these.

I claim:

1. A device for inserting laundry articles into a feeder, comprising a conveyor adapted to grip a stretched portion of a front edge of the laundry article and then convey the laundry article into a feeder with the front edge foremost in the direction of feed, an underlying horn positioned in front of the conveyor with respect to the direction of feed of the article so that the conveyor pulls the laundry article across the top of the underlying horn and below the conveyor and an overlying horn positioned with respect to the conveyor and the underlying horn such that the laundry article during insertion is pulled by the conveyor below the overlying horn and in engagement therewith, said overlying horn being pivotally mounted with respect to the underlying horn so that the overlying horn is displaceable between a lower position where it engages the laundry article and an upper position in which the overlying horn extends completely above the underlying horn.

2. The device of claim 1, wherein a front edge of the overlying horn, seen in the direction of feed, extends from a location below and behind a front edge of the underlying horn rearward to a location above the front edge of the underlying horn, whereby the laundry article follows a labyrinth path in the direction of feed.

3. The device of claim 1, including actuator means for causing pivotal displacement of the overlying horn.

4. The device of claim 3, wherein the actuator means is a pneumatic cylinder.

5. The device of claim 3, wherein the actuator means is adapted for manual operation by an operator of the device.

6. The device of claim 3, including at least a sensor positioned at the front end of the conveyor, with respect to the direction of feed for detecting the presence of a laundry article in the conveyor, and means for activating the actuator means in response to the detected presence of a laundry article so that the overlying horn is in its upper position when no laundry article is present in the conveyor, and is moved to its lower position when a laundry article is present in the conveyor.

7. The device of claim 1, wherein a front edge of each horn comprises a shaped wire or rod material.

8. The device of claim 1, wherein each horn is shaped with a pointed contour forwardly on a front edge thereof and then diverges rearwardly with respect to the direction of feed.

9. The device of claim 1, wherein the device forms part of the feeder.

* * * * *